US008434407B2

(12) United States Patent
Schulmeister

(10) Patent No.: US 8,434,407 B2
(45) Date of Patent: May 7, 2013

(54) ROTARY PRINTING PRESS

(75) Inventor: Peter Schulmeister, Pfaffenhofen (DE)

(73) Assignee: manroland AG, Offenbach/Main ( * ) Notice: Subject to any disclaimer, the term of this patent is extended or adjusted under 35 U.S.C. 154(b) by 828 days.

(21) Appl. No.: 12/233,533

(22) Filed: Sep. 18, 2008

(65) Prior Publication Data

US 2009/0071356 A1 Mar. 19, 2009

(30) Foreign Application Priority Data

Sep. 19, 2007 (DE) ..... 10 2007 044 622

(51) Int. Cl.
*B41N 1/00* (2006.01)

(52) U.S. Cl.
USPC ..... 101/478; 101/484; 347/19

(58) Field of Classification Search ..... 101/478, 101/484; 347/19
See application file for complete search history.

(56) References Cited

U.S. PATENT DOCUMENTS

| | | | | |
|---|---|---|---|---|
| 5,069,124 | A * | 12/1991 | Schneider | 101/142 |
| 5,906,156 | A * | 5/1999 | Shibuya et al. | 101/93.12 |
| 6,164,753 | A * | 12/2000 | Maza et al. | 347/32 |
| 6,595,615 | B2 * | 7/2003 | Ylitalo | 347/19 |
| 7,097,269 | B2 * | 8/2006 | Collette et al. | 347/19 |
| 7,469,636 | B2 * | 12/2008 | Dilling et al. | 101/142 |
| 2004/0246293 | A1 * | 12/2004 | Sanpei et al. | 347/22 |
| 2007/0024668 | A1 * | 2/2007 | Folkins | 347/43 |
| 2008/0018696 | A1 * | 1/2008 | Sanpei et al. | 347/23 |

FOREIGN PATENT DOCUMENTS

| | | | |
|---|---|---|---|
| DE | 100 37 616 | A1 | 8/2002 |
| DE | 10 2004 007 915 | A1 | 9/2005 |
| DE | 10 2006 016 065 | A1 | 10/2007 |
| JP | 01071781 | A * | 3/1989 |
| JP | 2005055604 | A * | 3/2005 |
| JP | 2007264255 | A * | 10/2007 |
| WO | WO 2005/068197 | | 7/2005 |

* cited by examiner

*Primary Examiner* — Daniel J Colilla
*Assistant Examiner* — David Banh
(74) *Attorney, Agent, or Firm* — Crowell & Moring LLP

(57) ABSTRACT

A rotary printing press is disclosed. The press includes at least one plate-free printing unit for printing a substrate web with a static print image for print copies of a print job and at least one plate-free printing unit, in particular an inkjet printing unit for printing the substrate web with a dynamic print image. The/each plate-free printing unit can be shifted from a printing position in which the substrate web can be printed by the same printing unit, into a service position in which no substrate web can be printed by the same printing unit. A device which is assigned to the service position is printable by at least one plate-free printing unit that is shifted into the service position, such that the printing parameters of the same can be verified and adapted to subsequent printing of the substrate web in the printing position.

9 Claims, 2 Drawing Sheets

ROTARY PRINTING PRESS

This application claims the priority of German Patent Document No. 10 2007 044 622.7, filed Sep. 19, 2007, the disclosure of which is expressly incorporated by reference herein.

BACKGROUND AND SUMMARY OF THE INVENTION

The invention relates to a rotary printing press.

Rotary printing presses have several printing units based on printing plates to print at least one substrate web, in particular multiple substrate webs, preferably printing them on both sides. The printing units based on printing plates are offset printing units in particular, whereby, with the help of offset printing units, the/each substrate web may be printed conventionally with a static print image, which is thus identical for all print copies of a print job. In the case of rotary printing presses, there is growing demand for printing the substrate webs, not only conventionally and statically by offset printing, but also individualizing the substrate webs in terms of printing technology by also printing the substrate webs dynamically by using printing units that do not use printing plates and/or are preferably designed as inkjet printing units, in addition to using static offset printing. It is already known from practice that plate-free printing units may be integrated into the rotary printing press downstream from the printing units that use printing plates and upstream from a folder, so that dynamic printing may be performed inline with static printing.

To ensure proper operation of plate-free printing units, such as inkjet printing units, it is necessary to regularly maintain the plate-free printing units and adjust their printing parameters, so that high-quality dynamic printing may be performed using the plate-free printing units, depending on the printing speed of the printing plate-based printing units that are used for static printing.

Thus, with a continuous inkjet printing unit, for example, a charging voltage of the electrodes and a phase ratio of a trigger voltage must be adapted for individual ink droplets, based on an input signal, to ensure a high print quality.

It is already known from practice that a plate-free printing unit may be designed to be portable and/or movable, so that they can be shifted from a printing position in which a substrate web is printable by the plate-free printing units, to a service position in which no substrate web is printable by the plate-free printing units, so that cleaning operations and adjustment operations may be performed on the plate-free printing units in the service position. In the past, problems have been encountered in verifying whether printing parameters set on a plate-free printing unit yield a good print quality.

With the printing presses known in practice, such verification may be performed only by printing the substrate web using a plate-free printing unit, and then individual print copies must be removed from the production stream to verify the print quality. This poses problems with rotary printing presses, because individual copies exist only in the area of the folder and can be removed for verification of whether printing parameters set on a plate-free printing unit result in a good print quality, so that, under some circumstances, a number of sheets of waste paper must be printed. There is, therefore, a demand for a rotary printing press on which the print quality achievable with the help of a plate-free printing unit can be verified easily while minimizing spoilage.

Against this background, the object of the present invention is to create a novel rotary printing press.

According to the invention, a device which is printable by at least one plate-free printing unit shifted into the service position, so that the printing parameters of the plate-free printing unit can be verified and adapted to subsequent printing of a substrate web in the printing position, is provided in the service position, according to this invention.

In the sense of the present invention, a device which is printable by at least one plate-free printing unit that has been shifted into the service position, is assigned to the service position for at least one plate-free printing unit, such that the print quality achievable by using the printing parameters set on the plate-free printing unit can be verified without printing the actual substrate web. In the service position, printing parameters of the plate-free printing unit can be adapted to subsequent printing of a substrate web, so that a plate-free printing unit can be set up for printing with virtually no spoilage.

Preferred further embodiments of the invention are derived from the following description. One exemplary embodiment of the invention, without being limited to this, is explained in greater detail below with reference to the drawings.

DETAILED DESCRIPTION OF THE DRAWINGS

Figure 1:
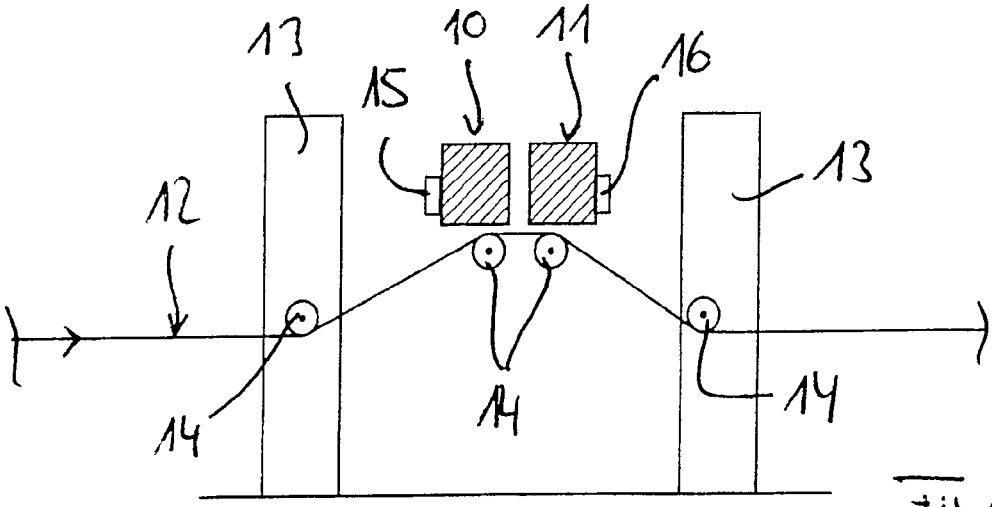
FIG. 1 shows a schematic detail of an inventive rotary printing press in a side view.
Figure 2:
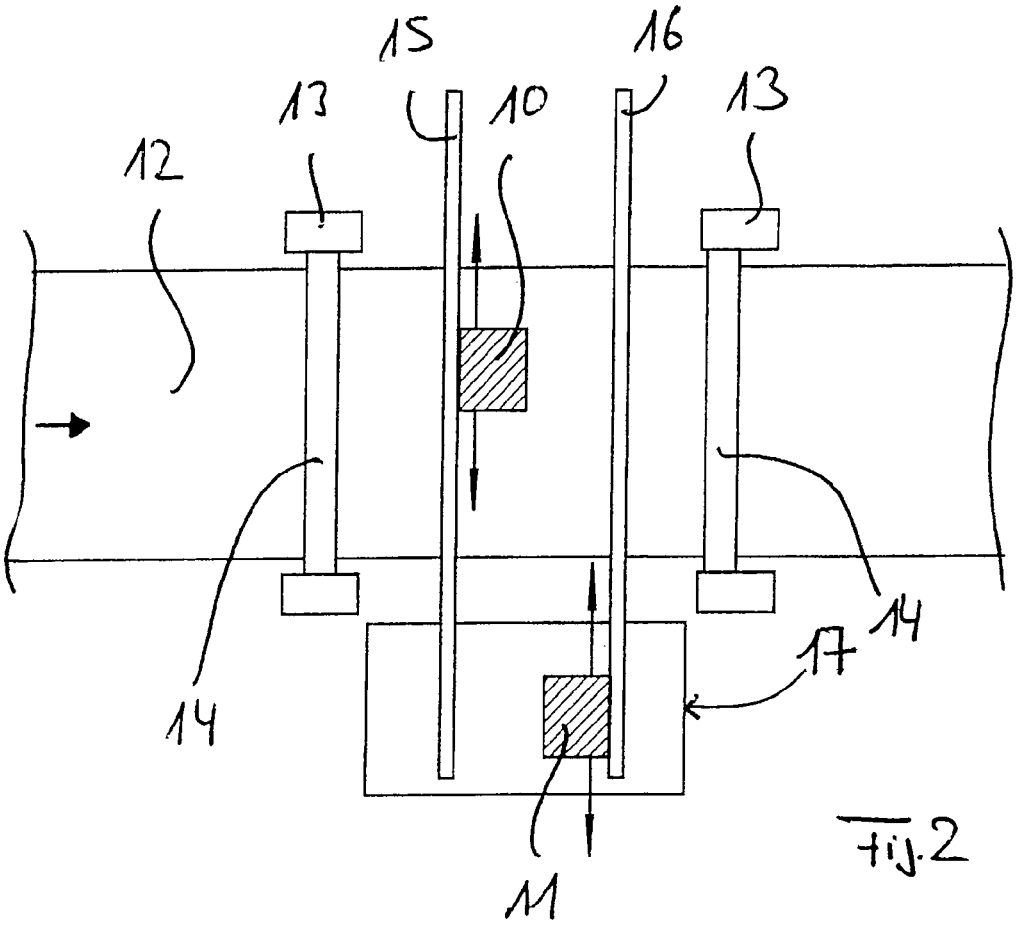
FIG. 2 shows the detail of FIG. 1 in a view from above.

FIGS. 1 and 2 show a detail of an inventive rotary printing press in the area of two plate-free printing units 10, 11, with the help of which a substrate web 12 can be printed dynamically and thus with a print image that varies for the print copies of a print job. The plate-free printing units 10, 11 are preferably arranged downstream from the printing plate-based printing units, as seen in the direction of conveyance of the substrate web 12. With the help of these printing plate-based printing units, the substrate web can be printed statically, and thus with a print image that does not vary over the copies of a print job. The printing plate-based printing units are preferably offset printing units. The plate-free printing units 10, 11 are preferably inkjet printing units.

According to FIGS. 1 and 2, the substrate web 12 to be printed is moved into the area of the plate-free printing units 10, 11 via sheet guidance elements 14 mounted on side walls 13, to thereby ensure an optimal relative position between the substrate web 12 to be printed and the plate-free printing units 10, 11 in the dynamic printing of the web.

Each plate-free printing unit 10, 11 is supported on a crossbar 15 and/or 16, according to FIGS. 1, 2, so that the unit can be moved across the direction of conveyance of the substrate web 12. This makes it possible to displace each of the plate-free printing units 10, 11 shown in FIGS. 1 and 2 individually, and therefore independently of the respective other plate-free printing unit from one printing position in which the substrate web 12 can be printed by the same, into a service position in which the substrate web 12 cannot be printed by the same. According to FIG. 2, plate-free printing unit 10 is in the print position, and plate-free printing unit 11 is in the service position. The service position in which the plate-free printing unit 11 is situated, according to FIG. 2, is thus positioned laterally next to the substrate web 12, such that, after a plate-free printing unit is in the service position, set-up work and cleaning jobs, for example, can be performed on such a plate-free printing unit that has been moved into the service position.

In particular, once a plate-free printing unit is in the service position, printing parameters can be adjusted on such a plate-free printing unit that is moved into the service position, so that the substrate web 12 is to be dynamically printed at a later point in time with the help of these parameters. In the sense of the present invention, a device 17, which can be printed by a plate-free printing unit 11 that is shifted into the service position, is assigned to the service position here, so that printing parameters set on the plate-free printing unit can be verified with regard to the achievable printing quality, and can be adapted to the subsequent dynamic printing of the substrate web 12.

The printing of device 17 with the plate-free printing unit 11 shifted into the service position is detectable and analyzable by means of the measurement technology, preferably via a sensor 18 assigned to the service position (see FIG. 3) to thereby automatically verify whether a good print quality can be achieved with the printing parameters set on the plate-free printing unit 11. The measured values detected by the sensor 18 can be analyzed so that the printing parameters of the plate-free printing unit 11 can be adapted, preferably automatically, in the sense of regulation.

The device 17 assigned to the service position comprises a cylinder 20, which can rotate and/or be driven to rotate in the direction of the arrow 19, and a printable plate 21, which is positioned on the circumference of the cylinder 20, such that the cylinder 20 can be driven so that a circumferential speed of the plate 21 to be printed corresponds to the speed of conveyance of the substrate web to be printed later by the plate-free printing unit 11. The printing conditions, under which the substrate web 12 is to be printed later by the plate-free printing unit 11, can be simulated accurately in this way.

In the simplest case, the plate to be printed, which is positioned on the circumference of the cylinder 20, and is to be printed by the plate-free printing unit 11 in the service position, is embodied in the form of printing paper attached to the circumference of the cylinder 20 with the help of a clamping mechanism, or with adhesive tape, for example.

The paper is printed over a maximum of one revolution of the cylinder 20, such that either the printing is detected by the sensor 18 or the printed paper is removed from the cylinder 20, to evaluate the print thereof in a different manner.

In contrast with that, it is also possible for the plate 21, which is positioned on the circumference of the cylinder 20 and is to be printed by the plate-free printing unit 11 in the service position, to be designed as an erasable and thus repeatedly printable plate 21. In the case of a plate-free printing unit 11, designed as an inkjet printing unit, such a plate 21 is preferably designed like a gravure plate, on the surface of which small nubs are formed, and are preferably coated with a material having a low surface energy. Such a plate 21 may then be printed by the plate-free printing unit 11 in the service position, in which case the print result is detected by the sensor 18 and evaluated, and then, following detection by the measurement technology, the printed plate is cleaned with at least one cleaning device and thereby erased, so that the printing plate 21 can be printed by the plate-free printing unit 11 many times in succession, over multiple revolutions of the cylinder 20.

Figure 3:
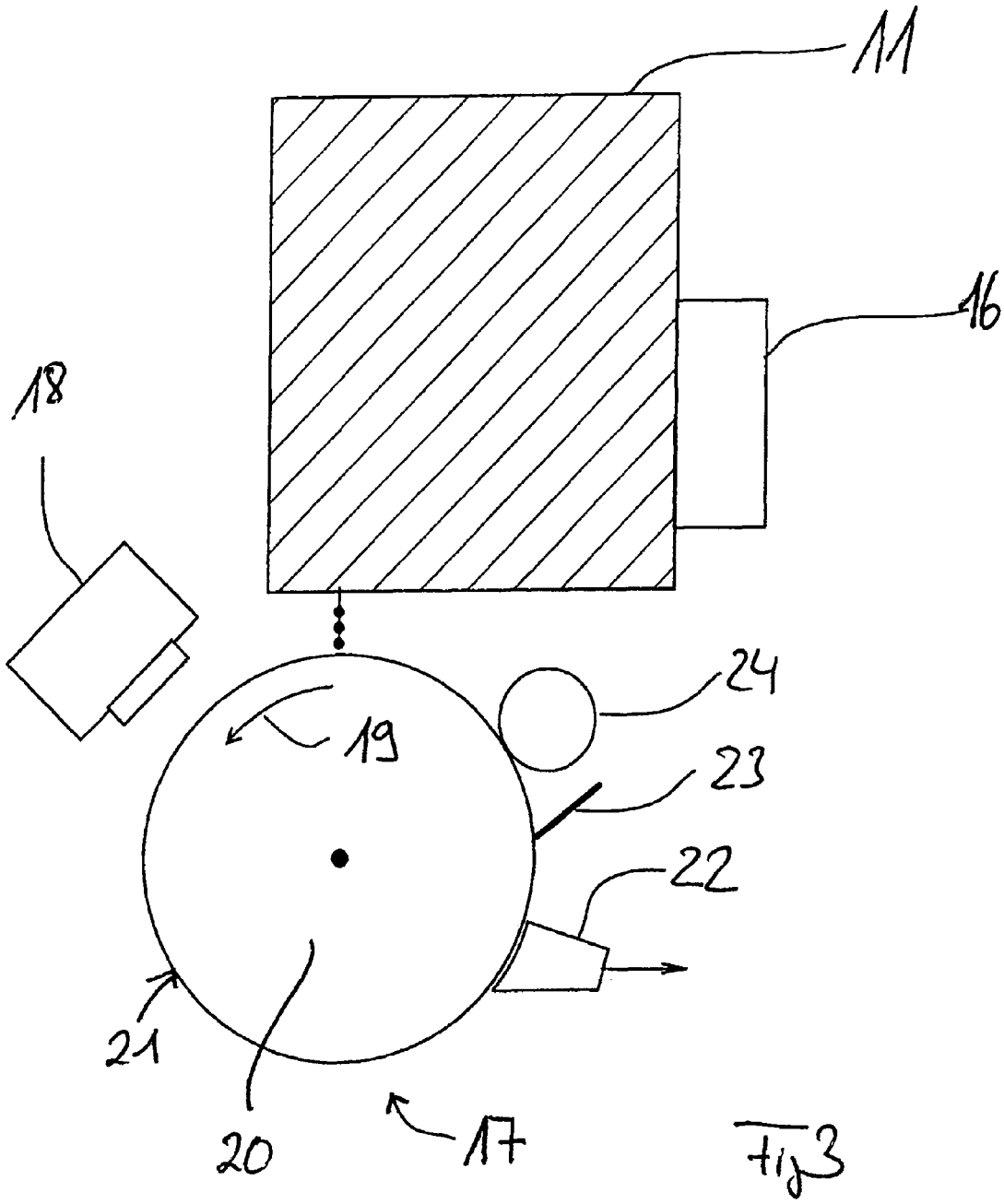
FIG. 3 shows a detail in a side view.

FIG. 3 shows a total of three different cleaning devices, namely a cleaning device designed as a suction device 22, a cleaning device designed as a doctor unit 23, and a cleaning device designed as a cleaning roll 24 carrying a nonwoven. With one or more such cleaning devices, the plate 21 positioned on the cylinder 20 can be cleaned and thus erased. The use of a suction device 22 as a cleaning device has the advantage that printing ink removed by suction from the gravure-like plate 21 can be recycled back to the ink cycle of a plate-free printing unit designed as an inkjet printing unit.

It is thus within the scope of the present invention to provide a service position with a device 17 which is assigned to this service position, the device being printable by at least one plate-free printing unit that has been shifted into the service position, and to provide this on the side next to the conveyance pathway of a substrate web 12 to be printed, so as to thereby adapt printing parameters of the plate-free printing unit to the subsequent printing of the substrate web 12. The device 17 assigned to the service position has a cylinder 20, which can be operated at any rotational speed, to thereby simulate, at its circumference, a circumferential velocity corresponding to the speed of conveyance of the substrate web 12 to be printed subsequently. In the service position, a printer can set all the printing parameters that are important for the plate-free printing process under conditions corresponding to the subsequent printing of the substrate web 12, such that the printing parameters can also be adapted automatically in the sense of regulation. An erasable and repeatedly printable plate is preferably positioned on the circumference, i.e., the surface of the cylinder 20 of the device 17, so that it can be printed over multiple revolutions of the cylinder 20 by the plate-free printing unit 11 that has been shifted into the service position. The printing of the plate 21 is detectable via a sensor, and it can be erased by at least one cleaning device.

In the exemplary embodiment according to FIGS. 1 and 2, in which there are two plate-free printing units 10, 11, a redundant printing operation is possible, such that one of the plate-free printing units, namely printing unit 10 according to FIG. 2, assumes the printing position, and the other of the plate-free printing units, namely printing unit 11 according to FIG. 2, assumes the service position. Since all the printing parameters of the plate-free printing units can be adapted to the subsequent printing of the substrate web 12 in the service position, it is possible to avoid printing of spoilage due to sub-optimal settings of printing parameters.

LIST OF REFERENCE NUMERALS

10 printing unit
11 printing unit
12 substrate web
13 side wall
14 sheet guidance element
15 crossbar
16 crossbar
17 device
18 sensor
19 direction of rotation
20 cylinder
21 plate
22 suction device
23 doctor
24. cleaning roll The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotary printing press, comprising a printing plate-based printing unit for printing a substrate web with a static print image for print copies of a print job, and a plate-free printing unit for printing the substrate web with a dynamic print image for the print copies of the print job, wherein the plate-free printing unit is shiftable from a printing position in which the substrate web is printable by the plate-free printing unit into a service position in which the substrate web is not printable by the plate-free printing unit, further comprising a device which is printable by the plate-free printing unit when the plate-free printing unit is shifted into the service position wherein the device comprises a rotationally drivable cylinder with a plate that is positioned on a circumference of the cylinder and wherein the cylinder is drivable so that a circumferential speed of the plate corresponds to a rate of conveyance of the substrate web to be printed by the plate-free printing unit, and further comprising a measurement device wherein a printing of the device is detectable and analyzable by the measurement device such that printing parameters of the plate-free printing unit are automatically adaptable for printing on the substrate web.

2. The rotary printing press according to claim 1, wherein the plate-free printing unit is an inkjet printing unit.

3. The rotary printing press according to claim 1, wherein the measurement device includes a sensor.

4. The rotary printing press according to claim 1, wherein the plate that is positioned on the circumference of the cylinder is embodied as a printing paper that is printable once.

5. The rotary printing press according to claim 1, wherein the plate that is positioned on the circumference of the cylinder is embodied as an erasable and therefore repeatedly printable plate.

6. The rotary printing press according to claim 5, wherein an erasing device is assigned to the service position and wherein the printable plate is erasable by the erasing device.

7. A method for operating a rotary printing press, comprising the steps of:

printing a substrate web with a static print image by a printing plate-based printing unit;

shifting a plate-free printing unit from a printing position in which the substrate web is printable by the plate-free printing unit into a service position in which the substrate web is not printable by the plate-free printing unit;

printing a device by the plate-free printing unit when the plate-free printing unit is shifted into the service position, wherein the device is a rotationally drivable cylinder with a plate that is positioned on a circumference of the cylinder;

driving the cylinder such that a circumferential speed of the plate corresponds to a rate of conveyance of the substrate web;

automatically adapting printing parameters of the plate-free printing unit for printing on the substrate web by sensing a printing on the device printed by the plate-free printing unit;

shifting the plate-free printing unit from the service position to the printing position; and printing the substrate web with a dynamic print image by the plate-free printing unit after the plate-free printing unit is shifted to the printing position on a basis of the automatically adapted printing parameters.

8. The method according to claim 7, wherein the plate-free printing unit is an inkjet printing unit.

9. The method according to claim 7, further comprising the step of erasing the device printed by the plate-free printing unit.

* * * * *